US005552571A

United States Patent [19]

Runge

[11] Patent Number: 5,552,571

[45] Date of Patent: Sep. 3, 1996

[54] PUSH-BUTTON SWITCH HAVING A PLURALITY OF SIMULTANEOUSLY CLOSED CONTACTS

[75] Inventor: Klaus Runge, Uhldingen, Germany

[73] Assignee: Bodenseewerk Geratetechnik GmbH, Uberlinger/Bodensee, Germany

[21] Appl. No.: 304,606

[22] Filed: Sep. 12, 1994

Related U.S. Application Data

[63] Continuation of Ser. No. 872,018, Apr. 22, 1992, abandoned.

[30] Foreign Application Priority Data

Apr. 23, 1991 [DE] Germany ..... 41 13 180.0

[51] Int. Cl.[6] ..... H01H 13/64

[52] U.S. Cl. ..... 200/530; 200/243; 200/540; 200/406

[58] Field of Search ..... 200/406, 519, 200/521, 530, 534, 540, 245, 16 A, 243, 51.06, 512, 517

[56] References Cited

U.S. PATENT DOCUMENTS

| | | | |
|---|---|---|---|
| 3,225,168 | 12/1965 | Grimes et al. | 200/530 |
| 3,876,845 | 4/1975 | Griffith et al. | 200/406 |
| 3,940,578 | 2/1976 | Pointon | 200/245 |
| 4,324,472 | 4/1982 | Tevada et al. | 200/517 X |
| 4,885,443 | 12/1989 | Simcoe et al. | 200/517 X |
| 4,956,528 | 9/1990 | Janniere et al. | 200/530 X |

FOREIGN PATENT DOCUMENTS

| | | |
|---|---|---|
| 0076450 | 4/1983 | European Pat. Off. . |
| 0336797 | 9/1990 | European Pat. Off. . |
| 2247905 | 9/1972 | Germany . |
| 3212937 | 4/1982 | Germany . |
| 3505418 | 2/1985 | Germany . |
| 2081512 | 1/1982 | United Kingdom . |

*Primary Examiner*—Renee S. Luebke
*Attorney, Agent, or Firm*—Dougherty, Hessin, Beavers & Gilbert

[57] ABSTRACT

With push button operated switches having at least one movable and one stationary contact carrier, problems may occur when the push button is not actuated properly and centrally. This problem is overcome by a switch having corresponding annular contacts and concentric guide means.

14 Claims, 5 Drawing Sheets

PUSH-BUTTON SWITCH HAVING A PLURALITY OF SIMULTANEOUSLY CLOSED CONTACTS

This is a continuation of application Ser. No. 07/872,018, filed on Apr. 22, 1992 and now abandoned.

TECHNICAL FIELD

The invention relates to a push-button switch which serves to close a plurality of contacts simultaneously.

BACKGROUND ART

A number of push-button-operated switches are known with a movable contact carrier which can be moved with respect to a stationary contact carrier in order to bring contacts arranged on the contact carriers into conductive connection. The movable contact carrier may simply be biased by one or more return springs. Also, snap action devices may be provided in which, during a single opening process or during a single closing process, the energy for the switching process is, at first, stored and is then released in order to initiate and to support the movement of the movable contact carrier. These snap-action devices may be compression springs with a snap-action rocking device, leaf springs with a snap-action effect or disk or plate springs with a snap-action effect.

DE-OS 35 08 418 discloses a push-button switch in which a movable contact carrier, which is connected by an elastic pad to an actuated rod and is movable against two stationary contacts. These elements are arranged in a housing. The actuated rod is actuated to close the contact by a key extending over the housing.

The return spring is a resilient body which has substantially the configuration of a hollow cylinder and which is arranged between the housing and the key. In this case shifting or angular displacement of the elastic body can only, it at all, be avoided by complex and elaborate arrangements. Completely parallel movement of the contact surfaces cannot be insured.

DE-OS 32 12 937 describes a push-button switch having a contact carrier with a contact having the form of an annular disk concentric to an actuator rod. When the push-button switch is actuated, the actuator rod is rotated about its axis by a turning and switching device. There are no provisions to safely avoid moving out of line of the actuated rod and to provide for safe contact.

DE-AS 22 47 905 discloses a push-button switch having a stationary contact carrier with an annular contact. The movable contacts are provided on contact plates which are, in turn, moved by simple cylindrical actuating pins in a way that moving out of line is not avoided and safe contact is not insured.

When these switches are used for opening or closing two or more circuits, it is often desirable or even necessary that all circuits are definitely opened or closed at the same moment, even if the actuated push button is not operated carefully and is not pushed exactly centrally. Such a careful operation normally cannot be insured. This is particularly true in situations where a plurality of switches are to be operated consecutively within a short period of time, even more, when the operator has to use more than one finger to operate several switches at once or during a short period of time, and even more when switches and operator are in a vehicle which is subject to accelerations or vibrations as may be the case in an aircraft. In such applications, however, deficiencies in contact making may have extremely serious effects.

OBJECT OF THE INVENTION

One object of the invention is to provide a push-button switch which insures closing and opening of all contacts involved reliably and simultaneously, even if the push buttons operating the switch are operated without care, e.g., out of center.

DISCLOSURE OF THE INVENTION

According to the invention these objects are achieved in that the switch comprises a housing with a guide hole therein; first, stationary contact carrier means provided in said housing; a plurality of mutually concentric, first annular contacts attached to said first contact carrier means coaxially to said guide hole; second, movable contact carrier means provided with a guide pin, said guide pin being guided for axial movement in said guide hole; and a plurality of mutually concentric second annular contacts attached to said second contact carrier means coaxially to said guide pin.

This arrangement provides for safe contact making of a plurality of contact elements, even if the switch is actuated without care or under difficult conditions.

Further objects of the invention are achieved by features disclosed in the claims.

PREFERRED EMBODIMENTS OF THE INVENTION

Figure 1:
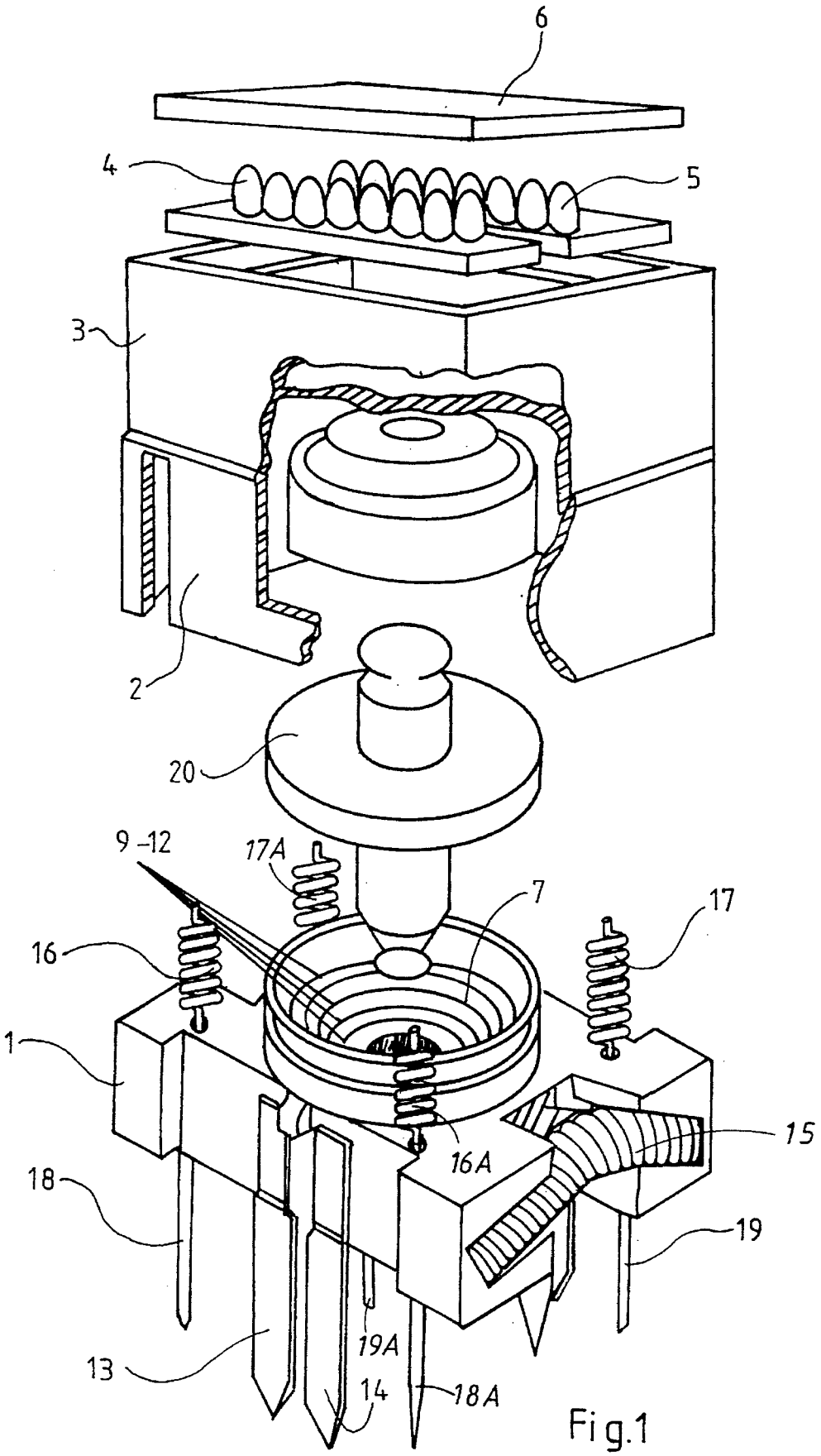
FIG. 1 is, in an exploded view, a simplified perspective illustration of a switch according to the invention.
Figure 2:
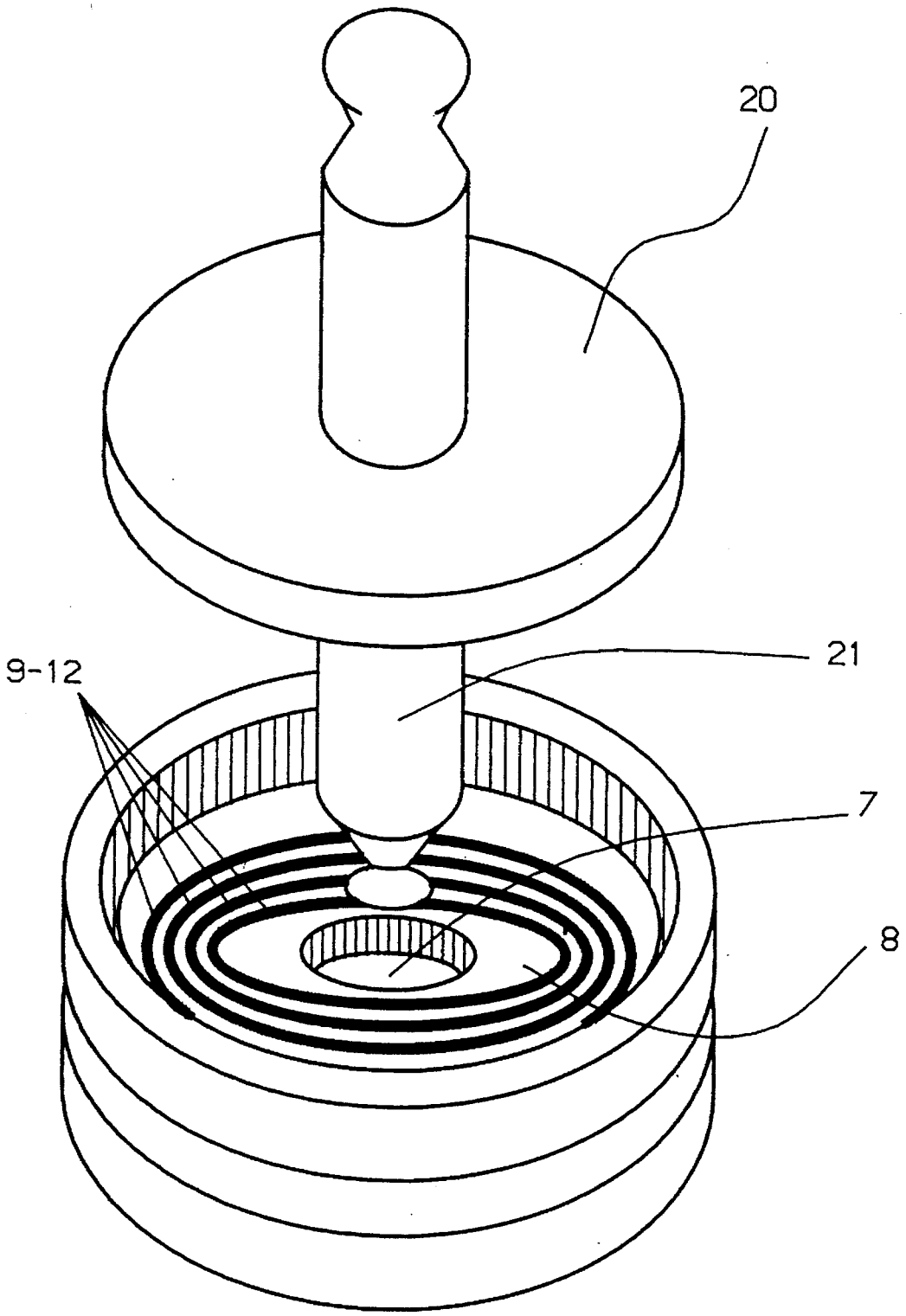
FIG. 2 is an enlarged partial view of FIG. 1.

In FIG. 1, reference numeral 1 designates a switch socket and reference numeral 2 designates a switch cover. The switch cover 2 can be pushed onto the socket and can be secured to the socket, in its pushed-on position, by snap-in devices (not shown in the drawing). Reference numeral 3 designates a push-button for actuating the switch. Push-button 3 is movable, through a limited distance, within the housing provided by socket 1 and cover 2. A plurality of light-emitting diodes 4 and 5 are arranged in push button 2 to display signals. Diodes 4 and 5 are covered by a common translucent cover plate 6. Diodes 4 and 5 may indicate the purpose of the switch, give instructions how or when to use the switch, or to indicate a status.

A guide hole or bore 7 is provided in the switch socket 1. Four concentric annular contacts are arranged on a contact carrier 8 around the hole 7 and coaxial with the axis of hole 7. Contact carrier 8 may be integrated with switch socket 1 or can be attached to switch socket 1. There are, not shown in the drawings, means for centering the contact carrier 8 in respect to the guide hole 7. The annular contacts 9 to 12 are provided on the upper plane surface of contact carrier 8 by printed circuit technique. They are connected by conductors (not shown in the drawings) within switch socket 1 with terminals, two terminals 13 and 14 being visible in FIG. 1.

Compression springs are arranged in the switch socket 1 on opposite sides thereof. One of these compression springs with the reference numeral 15 can be seen in FIG. 1. When the switch has been assembled, these compression springs, e.g., 15, engage push-button 3, the compression springs serving as return springs for the push-button.

Furthermore, springs 16, 16A, 17, 17A are provided on the switch socket 1. These springs cooperate and are connected to terminals 18, 18A, 19, 19A. They serve as current supply lines to the light-emitting diodes 4, 5 in the push-button 3. A larger number of springs 16, terminals 18 and light-emitting diodes 4 than that illustrated in the drawing may be provided.

Figure 3:
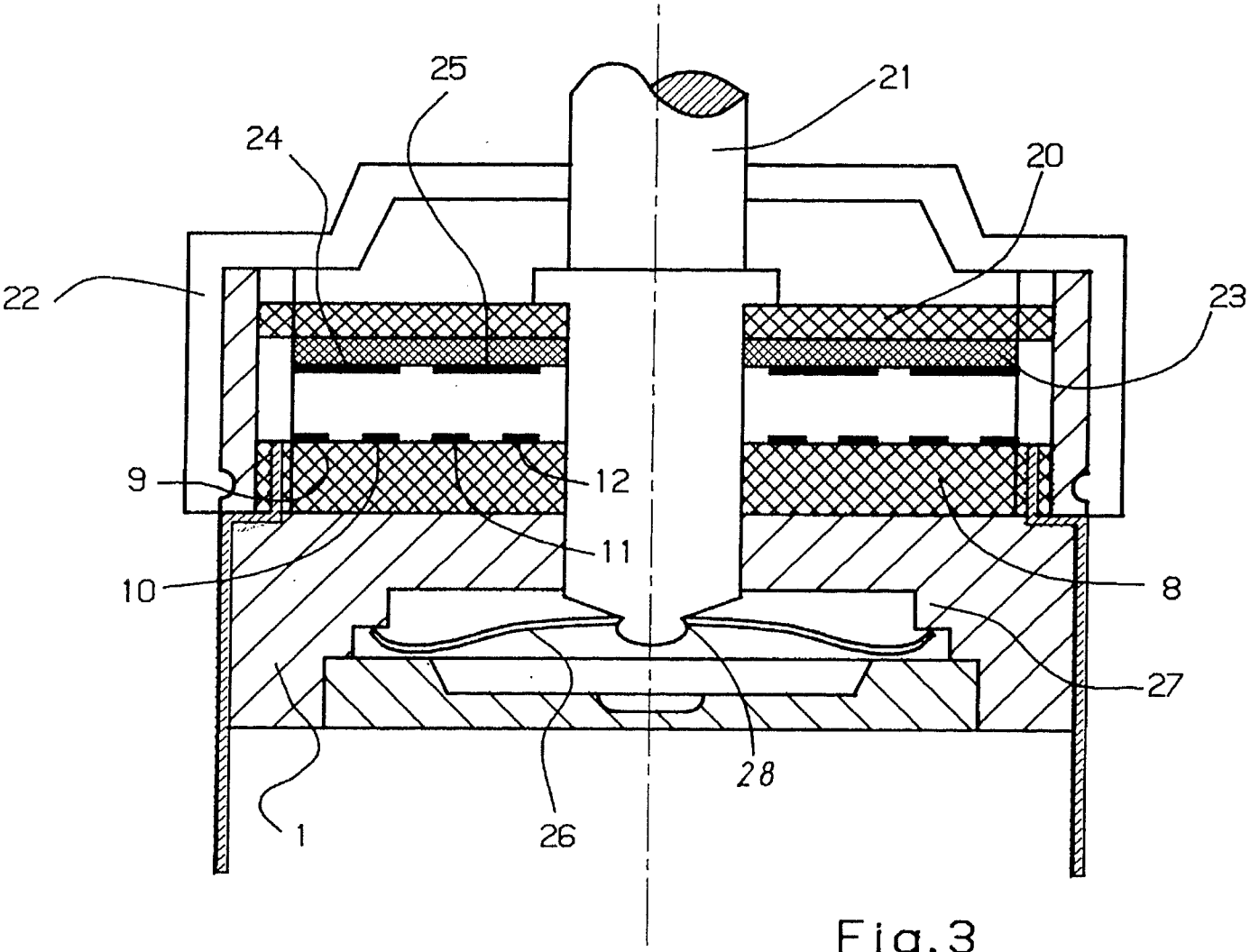
FIG. 3 is a simplified sectional view of the contact carriers of a switch, with contacts thereon.
Figure 4:
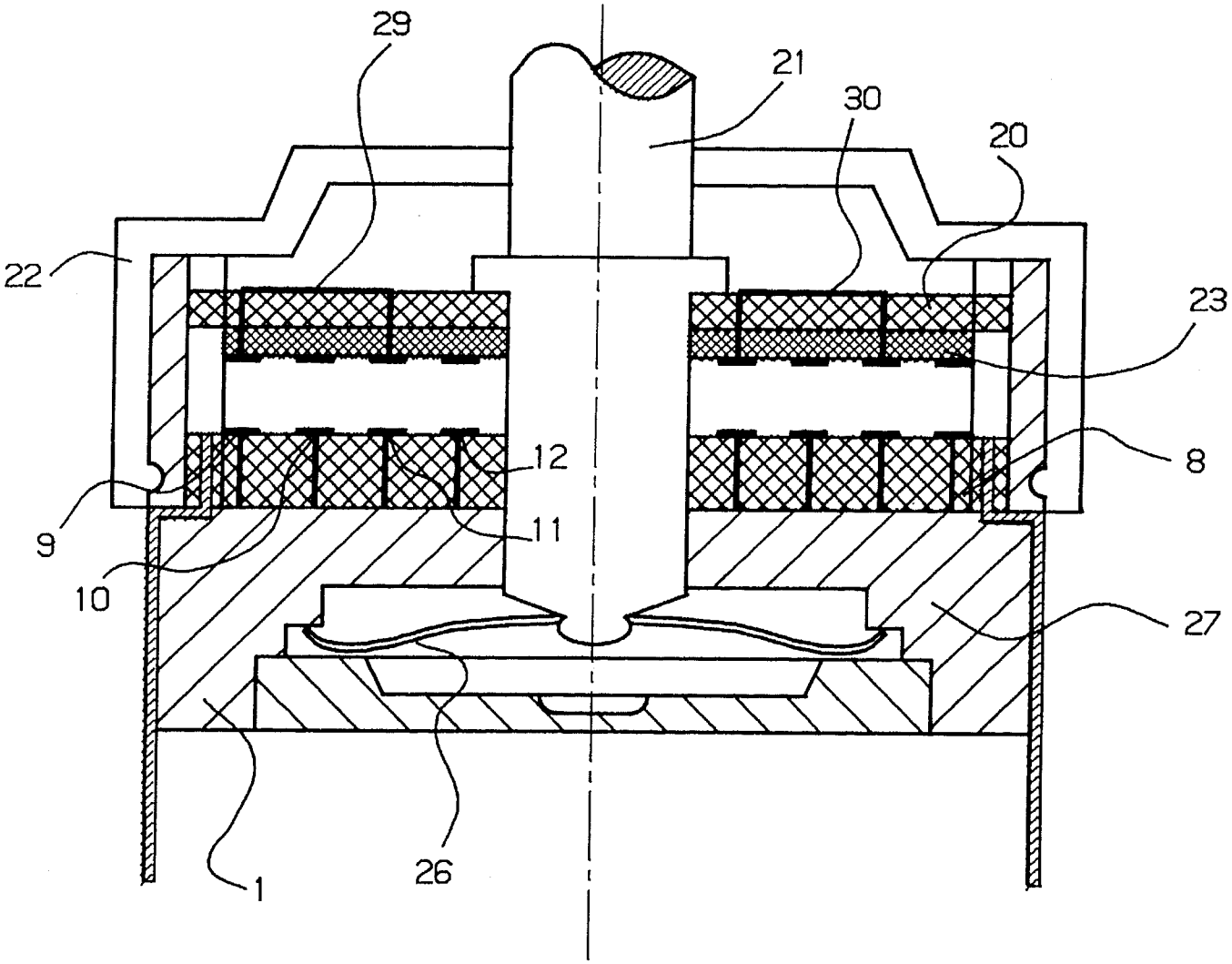
FIG. 4 shows an arrangement as in FIG. 3, with different interconnections of the contacts on the movable contact carrier.

Reference numeral 20 in the drawing designates a contact of annular shape on a guide pin 21. Pin 21 is movable in the guide hole 7, whereby the movable contact carrier 20 can be brought into contact with the stationary contact carrier 8. Further annular contacts concentric to guide pin 21 are provided on the underside of the movable contact carrier 20, as can be seen in FIGS. 3 and 4. These annular contacts are not visible in FIG. 1. Guide pin 21, inside push-button 3, engages or is integral with the push-button 3. Thus, guide pin 21 can be moved together with the movable contact carrier 20 by push-button 3 lengthwise of guide pin 21. A protective cover 22 serves to protect the contacts on contact carriers 8 and 20.

As can be seen in the partial view of FIG. 3, the switch socket has the reference number 1. Annular contacts 9 to 12 are provided on the stationary contact carrier 8 arranged thereon. Further, annular contacts 24 and 26 are connected to the underside of the movable contact carrier 20 through a resilient layer 23.

When the guide pin 21 moves downward, the movable contact carrier 20 follows until its contacts 24, 25 come into galvanic contact with contacts 9 to 12 of the stationary contact carrier 8. Even if the movable contact carrier 20 and the stationary contact carrier are not moved exactly parallel to each other, perfect contacts will be obtained.

As can be seen in FIG. 3, a plate spring 26 in the switch socket 1 engages projecting parts 27. The plate spring 26 abuts the guide pin 21 or is, at 28, in connection with the guide pin 21.

In FIG. 4, there are four concentric annular contacts on the movable contact carrier. They correspond to contacts 9 to 12 on the stationary contact carrier 8. In this case conductive connecting members or bridges therefor 29, 30 serve to interconnect non-neighboring contacts on the movable contact carrier 20. When this switch is closed, the contacts 9 and 11, or respectively 10 and 12 of the stationary contact carrier, are interconnected.

Figure 5:
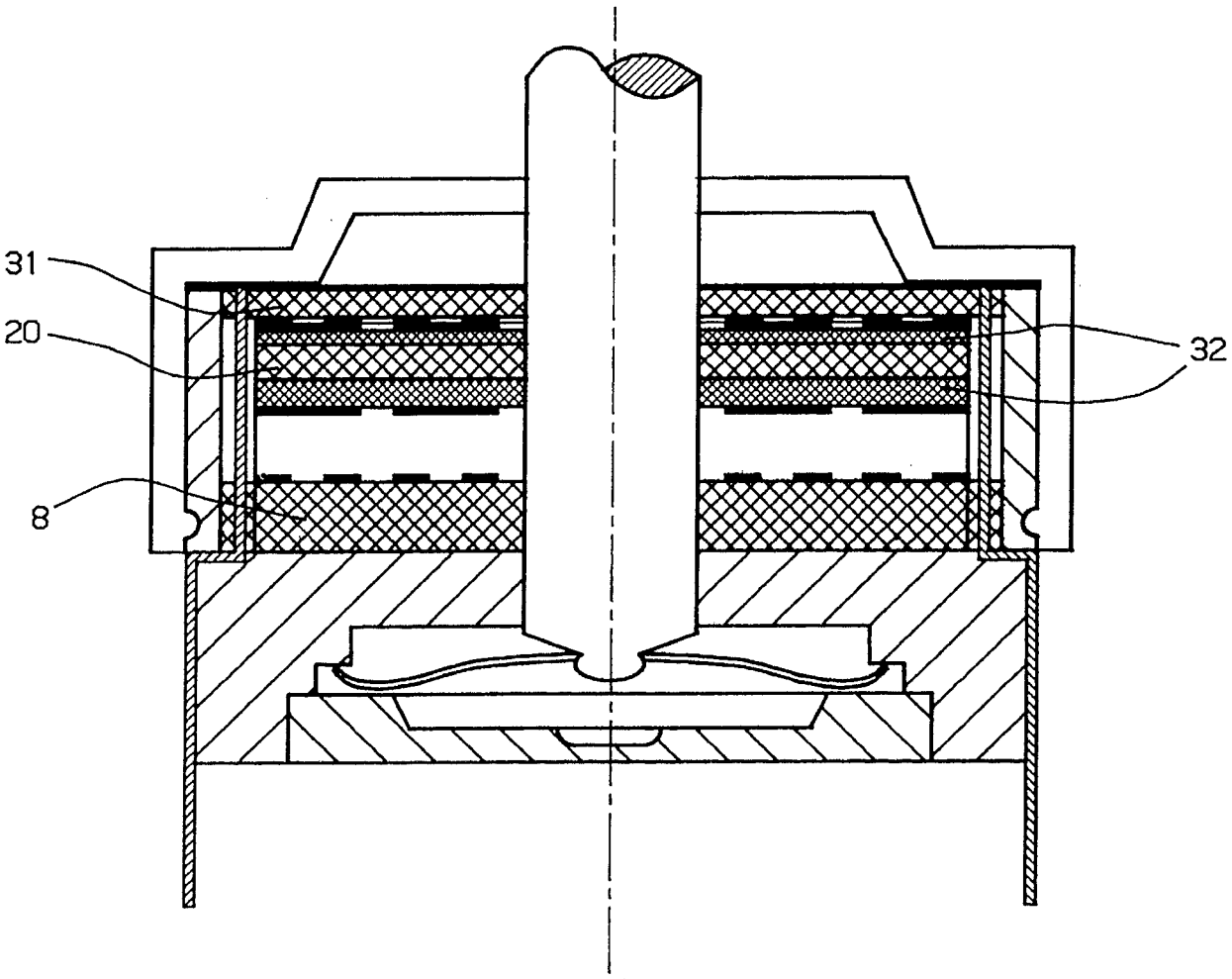
FIG. 5 shows, in a similar way as in FIGS. 3 and 4, details of a switch with one movable contact carrier arranged between two stationary contact carriers.

In the embodiment of FIG. 5, the movable contact carrier 20 is provided with contacts on both sides with resilient layers 32 in between. Furthermore, another stationary contact carrier 31 is located above the movable contact carrier 20. This allows either the lower contacts of the movable contact carrier 20 to make contact with those of the lower stationary contact carrier 8 or the upper contacts of the movable contact carrier 20 to make contact with the upper stationary contacts of the stationary contact carrier 31.

I claim:

1. A push-button switch comprising:

a plurality of contact carriers movable with respect to each other, wherein:

at least one of said contact carriers defines a guide hole therein; and one of said contact carriers has a guide pin thereon;

at least one first annular contact arranged at one of said contact carriers; and a plurality of concentric, second annular contacts arranged at another of said contact carriers on a plane surface and having different radii, said second annular contacts being initially axially spaced from said first annular contact and substantially coaxial with said guide pin and guide holes and arranged to establish, upon axial movement of the guide pin and corresponding relative axial movement between said first annular contact and said second annular contacts, simultaneous engagement and electrical connection with said first annular contact.

2. The switch of claim 1 wherein:

said contact carrier with said guide pin thereon is a movable contact carrier; and at least one of said contact carriers defining said guide hole is a stationary contact carrier.

3. The switch of claim 2 wherein said guide pin extends through said movable contact carrier.

4. The switch of claim 2 wherein said movable contact carrier is disk shaped.

5. The switch-of claim 2 wherein said stationary contact carrier is disk shaped.

6. A push-button switch comprising:

a plurality of contact carriers movable with respect to each other, wherein:

at least one of said contact carriers defines a guide hole therein and is a stationary contact carrier; and at least another one of said contact carriers is a stationary contact carrier;

one of said contact carriers has a guide pin thereon and is a movable contact carrier disposed between two stationary contact carriers; at least one first annular contact arranged at one of said contact carriers; and a plurality of concentric, second annular contacts arranged at another of said contact carriers on a plane surface and having different radii, said second annular contact being substantially coaxial with said guide pin and guide holes and arranged to establish, upon axial movement of the guide pin, simultaneous electrical connection with said first annular contact, wherein at least one contact is arranged on both sides of said movable contact carrier.

7. The switch of claim 6 wherein said guide pin extends through said movable contact carrier.

8. The switch of claim 6 wherein said movable contact carrier is disc shaped.

9. The switch of claim 6 wherein said stationary contact carriers are disc shaped.

10. A push-button switch comprising:

a housing with a guide hole therein;

first, stationary contact carrier means provided in said housing;

a plurality of mutually concentric, first annular contacts attached to said first contact carrier means, such that said first annular contacts are coaxial to said guide hole;

second, movable contact carrier means provided with a guide pin, said guide pin being guided for axial movement in said guide hole;

a plurality of mutually concentric second annular contacts attached to said second carrier means, such that said second annular contacts are coaxial to said guide pin;

said first, stationary contact carrier means comprising a pair of spaced, stationary contact carriers, said stationary contact carriers having surfaces facing each other, said guide pin extending through both of said stationary contact carriers;

said stationary contact carriers each having a plurality of concentric carriers each having a plurality of concentric, annular contacts coaxial with said guide pin;

said second, movable contact carrier means comprising a movable contact carrier attached to said guide pin between said facing surfaces of said stationary contact carriers, said movable contact carrier having a plurality of opposite surfaces; and sets of concentric, annular contacts being provided on each side of said movable contact carrier to cooperate with an adjacent set of said annular contacts of the adjacent one of said stationary contact carriers.

11. A push-button switch as claimed in claim 10, wherein said first and second concentric annular contacts are annular conductors provided, by printed circuit technique, on a plane surface of a corresponding one of said first and second contact carrier means.

12. A push-button switch as claimed in claim 10, wherein said second, movable contact carrier means comprises:

a contact carrier having a surface facing said first, stationary contact carrier means and said first annular contacts; and a resilient layer on said surface, said second annular contacts being attached to said resilient layer.

13. A push-button switch as claimed in claim 10, wherein resilient layers are provided on each of said opposite surfaces of said movable contact carrier, each of said sets of concentric, annular contacts being attached to one of said resilient layers.

14. A push-button switch as claimed in claim 10, wherein:

said first and second concentric annular contacts are of equal numbers; and each contact of said plurality of mutually concentric second annular contacts attached to said second contact carrier means is arranged to contact only an associated one of said plurality of mutually concentric, first annular contacts attached to said first contact carrier means, said second annular contacts being interconnected by conductors to establish, upon actuation of said switch, connections between said first annular contacts.

* * * * *